US008225697B2

(12) United States Patent
Cink et al.

(10) Patent No.: US 8,225,697 B2
(45) **Date of Patent: *Jul. 24, 2012**

(54) TOOL AND METHOD FOR REMOVING AND INSTALLING A TAMPER-RESISTANT CAP OF A PEST CONTROL DEVICE

(75) Inventors: James H. Cink, St. Louis, MO (US); Jonathan D. Berger, St. Louis, MO (US); Steven R. Sims, St. Louis, MO (US); Lee M. White, St. Louis, MO (US)

(73) Assignee: BASF Corporation, Florham Park, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/178,214

(22) Filed: Jul. 7, 2011

(65) Prior Publication Data

US 2011/0259153 A1 Oct. 27, 2011

Related U.S. Application Data

(63) Continuation of application No. 11/844,875, filed on Aug. 24, 2007, now Pat. No. 8,061,238, which is a continuation-in-part of application No. 10/236,659, filed on Sep. 6, 2002, now Pat. No. 7,272,993.

(51) Int. Cl.
*B67B 7/14* (2006.01)

(52) U.S. Cl. ..... 81/3.41; 81/3.29

(58) Field of Classification Search ..... 81/3.07, 81/3.29, 3.4–3.44, 3.56, 3.09, 176.15, 176.2, 81/176.3; D8/18, 33, 39, 40

See application file for complete search history.

(56) References Cited

U.S. PATENT DOCUMENTS

| | | | | |
|---|---|---|---|---|
| 2,407,428 | A | 9/1946 | Kretchman | |
| 2,718,801 | A | 9/1955 | Finley | |
| 3,001,658 | A | 9/1961 | Herter | |
| 3,600,982 | A | 8/1971 | Tholen | |
| 3,618,428 | A | 11/1971 | Phipps | |
| 3,785,225 | A | 1/1974 | McKenna et al. | |
| 3,885,477 | A | 5/1975 | Shook | |
| 4,044,637 | A * | 8/1977 | Solica | 81/3.43 |
| 4,059,033 | A | 11/1977 | Johnson | |
| 4,374,464 | A | 2/1983 | Tillander | |
| 4,726,264 | A * | 2/1988 | Bost | 81/3.4 |
| 4,760,763 | A | 8/1988 | Trick et al. | |
| 4,836,065 | A * | 6/1989 | Setliff | 81/124.2 |
| 4,914,985 | A | 4/1990 | Proctor | |
| 5,000,062 | A | 3/1991 | Bergmeister | |
| 5,003,848 | A | 4/1991 | Ceccucci, Jr. | |
| D319,957 | S * | 9/1991 | Bergmeister | D8/42 |

(Continued)

*Primary Examiner* — Hadi Shakeri

(74) *Attorney, Agent, or Firm* — Armstrong Teasdale LLP

(57) ABSTRACT

A tool includes a hub, at least two opposed fingers depending from the hub, and at least two opposed skirt sections configured different from the fingers. The skirt sections depend from the hub and are disposed adjacent the fingers. The opposed skirt sections have a second transverse distance between lower edges thereof that is greater than a first transverse distance between lower edges of the opposed fingers. The fingers are resiliently moveable relative to the skirt sections. Each of the fingers is circumferentially spaced from the adjacent skirt section by a gap. At least a portion of the gap is formed in the hub. The at least two fingers and the at least two skirt sections are circularly aligned such that each of the fingers and each of the skirt sections lie on a common circle.

20 Claims, 12 Drawing Sheets

U.S. PATENT DOCUMENTS

| | | | | |
|---|---|---|---|---|
| D320,916 | S | 10/1991 | Riddle et al. | |
| 5,161,436 | A | 11/1992 | Stevenson | |
| 5,199,327 | A | 4/1993 | Stevenson | |
| 5,213,016 | A | 5/1993 | Kah, Jr. | |
| 5,329,726 | A | 7/1994 | Thorne et al. | |
| D349,746 | S | 8/1994 | DeYoreo | |
| D381,881 | S * | 8/1997 | Shaul et al. | D8/40 |
| D386,555 | S | 11/1997 | Krug | |
| 5,735,181 | A | 4/1998 | Anderson | |
| 5,873,193 | A | 2/1999 | Jenson | |
| 5,893,301 | A | 4/1999 | Hensley et al. | |
| 5,901,496 | A | 5/1999 | Woodruff | |
| 5,918,410 | A | 7/1999 | Knuppel | |
| 5,927,000 | A | 7/1999 | Bordes, Jr. | |
| 6,003,266 | A | 12/1999 | Woodruff | |
| 6,016,625 | A | 1/2000 | Bishoff et al. | |
| 6,065,241 | A | 5/2000 | Woodruff | |
| 6,071,529 | A | 6/2000 | Ballard et al. | |
| 6,158,166 | A | 12/2000 | Snell et al. | |
| 6,202,342 | B1 | 3/2001 | Edwards | |
| 6,235,301 | B1 | 5/2001 | Ballard | |
| 6,255,959 | B1 | 7/2001 | Lake et al. | |
| 6,272,791 | B1 | 8/2001 | Pleasants | |
| D456,058 | S | 4/2002 | Rollins | |
| 6,370,811 | B1 | 4/2002 | Masterson | |
| D539,867 | S | 4/2007 | Mediate | |
| D552,989 | S | 10/2007 | Vogel | |
| D552,990 | S | 10/2007 | Vogel | |
| 7,340,979 | B2 * | 3/2008 | Sawyer | 81/3.4 |
| 7,707,912 | B1 * | 5/2010 | Sparks | 81/3.4 |
| 2002/0124458 | A1 | 9/2002 | Clark | |
| 2002/0148157 | A1 | 10/2002 | Rollins | |

* cited by examiner

TOOL AND METHOD FOR REMOVING AND INSTALLING A TAMPER-RESISTANT CAP OF A PEST CONTROL DEVICE

CROSS REFERENCE TO RELATED APPLICATIONS

This application is a continuation of U.S. patent application Ser. No. 11/844,875 filed on Aug. 24, 2007, which is a continuation-in-part of U.S. patent application Ser. No. 10/236,659 filed on Sep. 6, 2002 (now U.S. Pat. No. 7,272,993). Both of these applications are hereby incorporated by reference in their entireties.

BACKGROUND

This invention generally relates to pest control devices, and more particularly to a keyed tool for use in removing and installing tamper-resistant caps associated with such pest control devices.

Pest control devices are formed in a wide variety of configurations. One type of popular pest control device utilizes a bait to lure the pest into the pest elimination device. An example of such a baiting device is used in control of insects, such as termites, rodents, such as rats, or other pests. With termites, for example, cavities are dug in the ground and bait holders are placed within those cavities. Such bait holders may then be filled with bait, such as wood or poison. Such systems must be inspected periodically, such as every one to three months, to determine if termites are active within the bait holder. When inspecting the bait within the bait holder, it is important that the personnel inspecting the bait not disturb the bait, which may cause the termites to abandon the bait holder altogether. As such, it is important that the bait holders are sealed well, to discourage tampering by unauthorized personnel or other animals, such as pets.

Typically, such bait stations are protected from disturbance by a cap placed over the stations at ground level. The cap serves many purposes, one of which is discouraging people or animals from disturbing the bait. Especially in the case of poison bait, such caps help protect unauthorized people and animals from accessing the bait. In order for authorized personnel to access the bait, however, a convenient removal scheme is necessary that allows easy access to the bait holders. Thus, a removable cap and corresponding tool are needed to adequately secure the bait within the station, while also being convenient to remove for periodic inspections.

SUMMARY OF THE INVENTION

Among the several objects and features of the present invention may be noted the provision of such a tool that permits efficient removal and installation of a pest control device cap; the provision of such a tool that is simple to use; the provision of such a tool that will not cause undue wear upon the cap or pest control device; and the provision of such a tool that allows inspection at ground level without stooping or bending over.

In one aspect, a tool for removing a cap from a pest control device wherein the cap has a top and a sidewall depending from the top generally comprises a hub, at least two fingers depending from the hub at an angle relative thereto, and at least two skirt sections configured different from the fingers. The fingers are in opposed relationship with each other and have a lower edge. The opposed fingers have a first transverse distance between the lower edges thereof so that inner surfaces of the fingers engage the sidewall of the cap when the cap is received by the tool. The lower edges of the fingers engage the pest control device when the cap is disposed on the pest control device and the cap is received by the tool. The skirt sections depend from the hub and are disposed adjacent the fingers and in opposed relationship with each other. The opposed skirt sections each have a lower edge and a second transverse distance between the lower edges thereof that is greater than the first transverse distance between the lower edges of the opposed fingers. The fingers are resiliently moveable relative to the skirt sections. Each of the fingers is circumferentially spaced from the adjacent skirt section by a gap. At least a portion of the gap is formed in the hub. The at least two fingers and the at least two skirt sections are circularly aligned such that each of the fingers and each of the skirt sections lie on a common circle.

In another aspect, a tool for removing a cap from a pest control device wherein the cap has a top and a sidewall depending from the top generally comprises a hub, at least two fingers depending from the hub at an angle relative thereto, and a skirt extending downward from the hub. The fingers are in circumferentially spaced relationship with each other and the skirt to cooperatively define a socket for receiving the cap within the tool. Each of the fingers has a lower edge and an outer surface. The outer surface of each finger has at least one working member formed therein adjacent the lower edge of the finger. The at least one working member tapers transversely inward from the outer surface to the lower edge of each finger. Each of the fingers is resiliently moveable relative to the hub. The skirt comprises a cutout for receiving a portion of the cap when the cap is received by the tool. The fingers and the skirt are circularly aligned such that each of the fingers and the skirt lie on a common circle.

In yet another aspect, a tool for removing a cap from a pest control device wherein the cap has a top and a sidewall depending from the top generally comprises a hub, at least two fingers depending from the hub at an angle relative thereto, and at least two skirt sections configured different from the fingers. The fingers are in opposed relationship with each other. The opposed fingers each have a lower edge and a first transverse distance between the lower edges thereof so that inner surfaces of the fingers engage the sidewall of the cap when the cap is received by the tool. The lower edges of the fingers engage the pest control device when the cap is disposed on the pest control device and the cap is received by the tool. The skirt sections depend from the hub and are disposed circumferentially adjacent the fingers and in opposed relationship with each other. The opposed skirt sections each have a lower edge. The opposed skirt sections have a second transverse distance between the lower edges thereof that is greater than the first transverse distance between the lower edges of the opposed fingers. The fingers are resiliently moveable relative to the skirt sections wherein the skirt sections are adapted to engage the sidewall of the cap when the cap is received by the tool and wherein the fingers are adapted to engage the sidewall of the cap with a first force when the cap is received by the tool. The skirt sections are adapted to engage the sidewall of the cap with a second force when the cap is received by the tool. The first force is greater than the second force. The at least two fingers and the at least two skirt sections are circularly aligned such that each of the fingers and each of the skirt sections lie on a common circle.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE INVENTION

Figure 1:
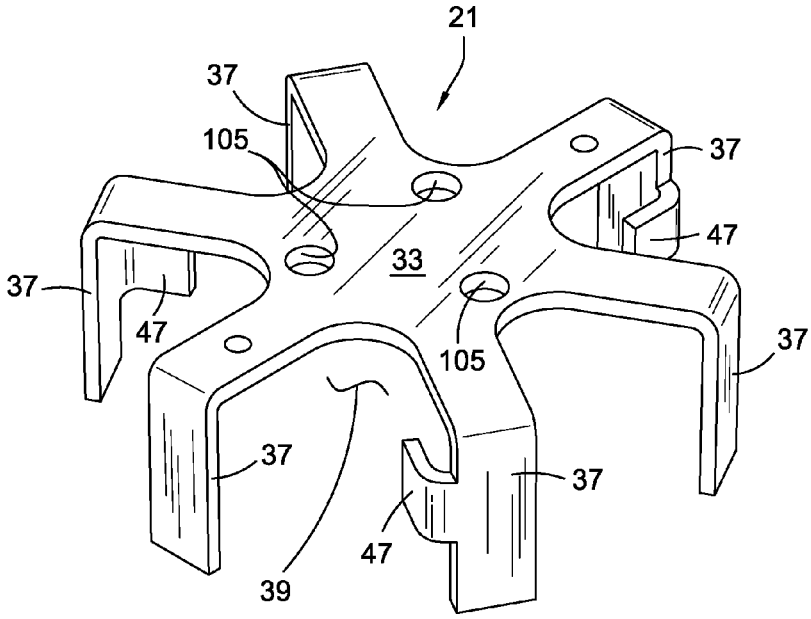
FIG. 1 is a perspective of a pest control device cap removal and installation tool of the present invention.
Figure 3:
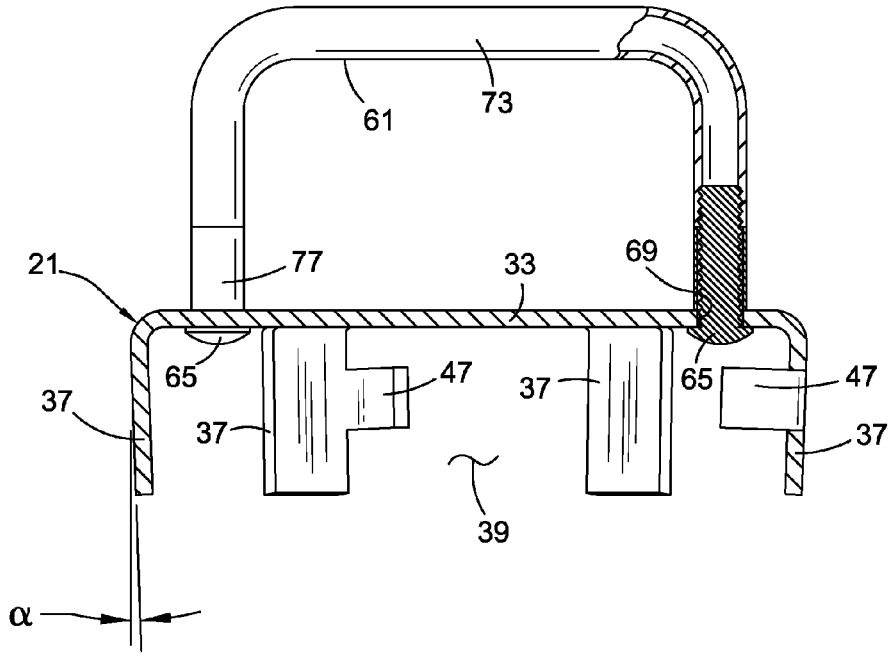
FIG. 3 is a section of the tool taken in a plane including line 3-3 of FIG. 2.
Figure 4:
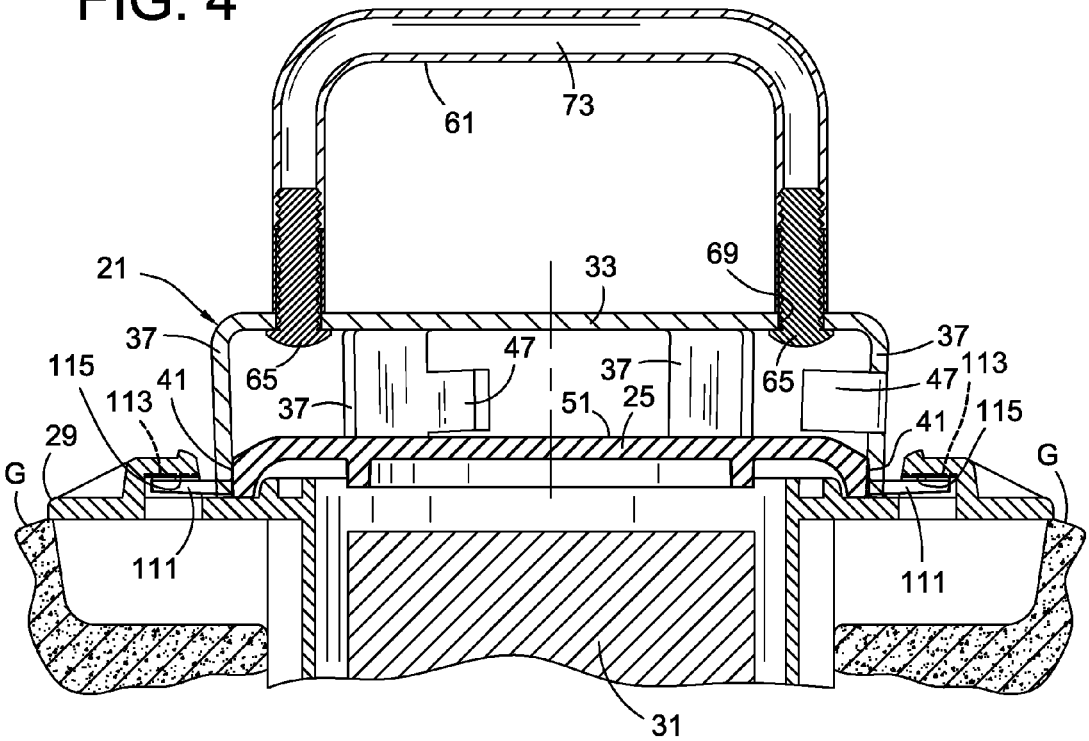
FIG. 4 is a section of the tool taken in a plane including line 4-4 of FIG. 2.
Figure 5:
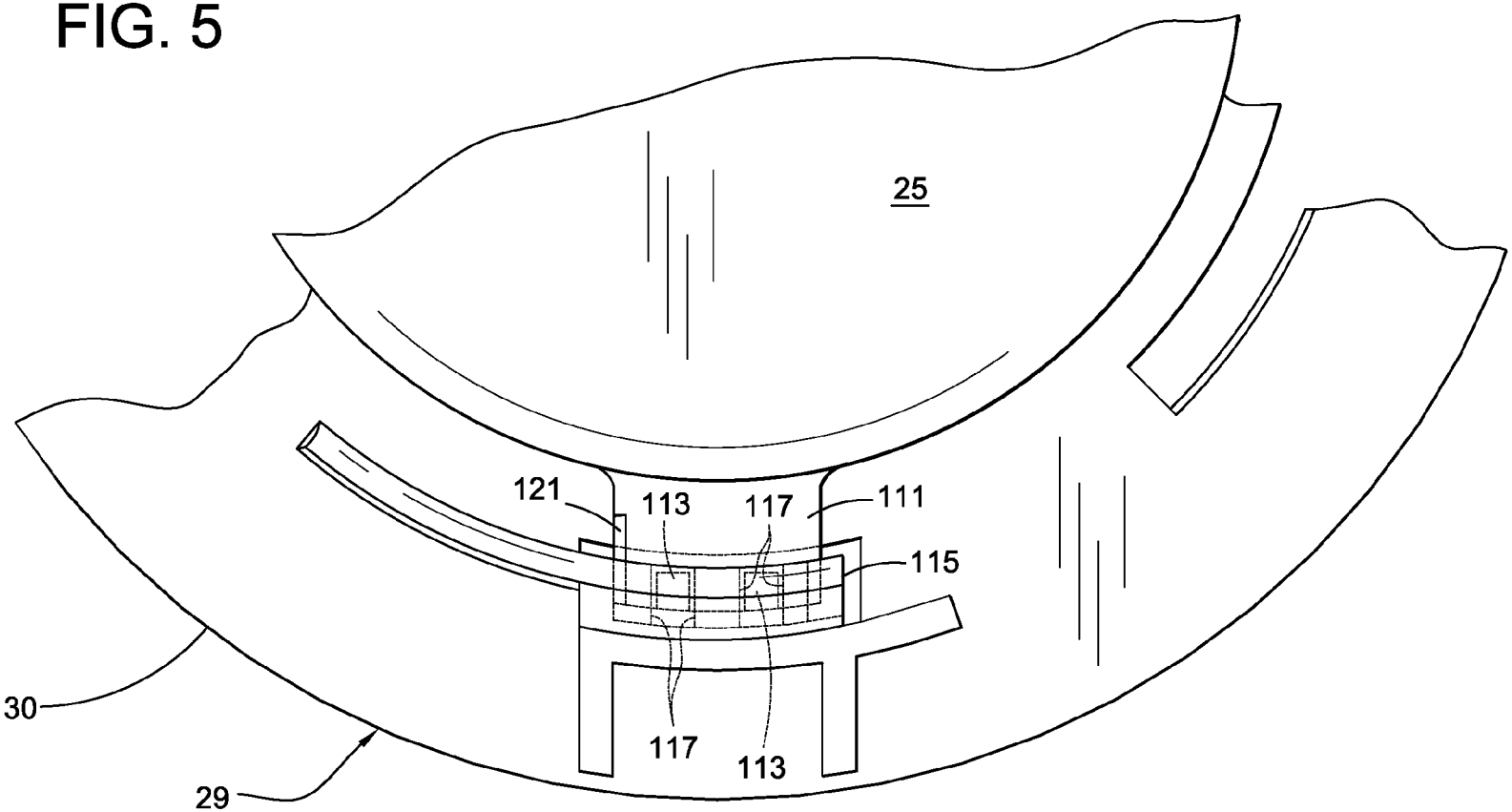
FIG. 5 is a partial top view of a bait holder and cap of the pest control device.

Referring now to the drawings and specifically to FIGS. 1, 4 and 5, a tool of the present invention is generally indicated 21. The tool is designed for removing a cap 25 from a pest control device, generally indicated 29. The pest control device includes a bait holder 30 containing bait 31 and the cap 25, which secures the bait in the bait holder. The tool 21 preferably comprises a hub 33 with fingers 37 extending radially outwardly from the hub. The fingers 37 then bend downward to an orientation generally parallel one another and substantially perpendicular to the cap 25. The fingers 37 cooperate to form a socket 39 for receiving the cap 25 and frictionally engaging a side edge 41 of the cap. In the preferred embodiment, the distal ends of the fingers 37, which engage the side edge 41 of the cap 25, are each formed in an unsprung position that is slightly inward from the side edge of the cap. As the fingers 37 engage the side edge 41, therefore, they move slightly outward, to a sprung position, to receive the side edge of the cap 25. Moving the fingers 37 to a sprung position enhances the frictional engagement of the tool 21 and cap 25, due to the increased force of the fingers pressing against the side edge 41. To achieve this finger position slightly inward from the side edge 41 of the cap 25, the fingers 37 angle slightly inward from vertical at an angle $\alpha$, as shown in FIG. 3. In the preferred embodiment, the angle $\alpha$ is between about one degree and about five degrees, and more particularly about two degrees.

Figure 2:
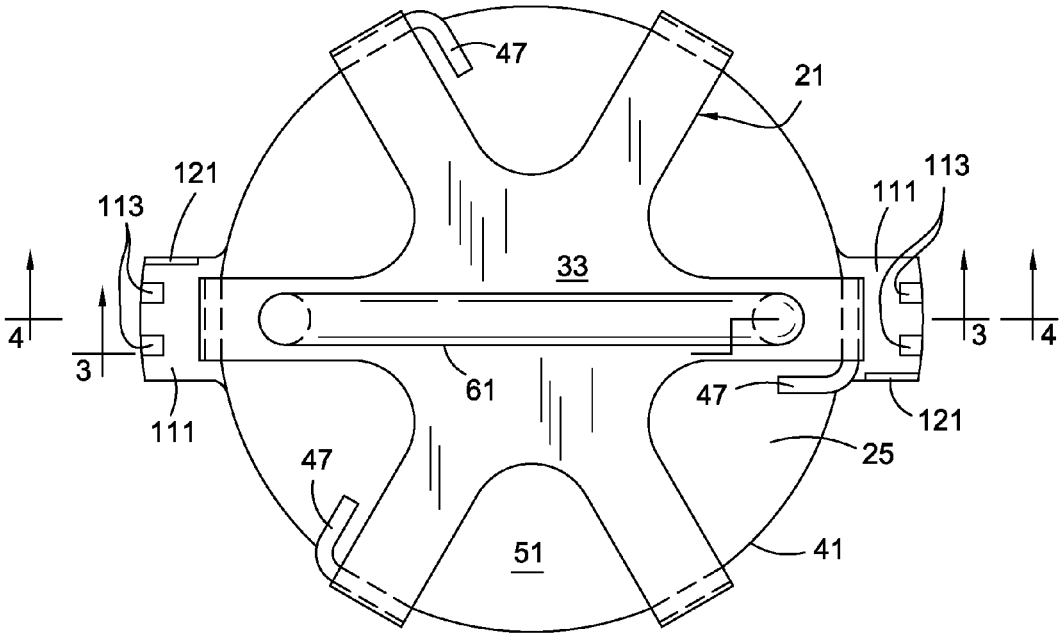
FIG. 2 is a top view of the tool of FIG. 1 with a handle installed and engaging a pest control device cap.

Referring to FIGS. 2 and 4, the fingers 37 are arranged circumferentially about the tool to form a circular socket 39 that corresponds with a circular cap 25. It is contemplated that caps of other shapes, such as polygons (e.g., a triangle, a square, a pentagon, a hexagon, etc.), may be used without departing from the scope of the present invention. A fewer or greater number of fingers 37 may cooperate to form a socket that accommodates a differently-shaped cap 25.

The tool 21 further includes stops 47 extending laterally inwardly in the socket 39 from the fingers 37 for engaging a top surface 51 of the cap 25. The top surface 51 of the cap 25 is transverse to the side edge 41 of the cap. The stops 47 are preferably integrally formed with the fingers 37 themselves, comprising portions of additional material bent laterally inward about a substantially vertical plane. The fingers 37 and stops 47 cooperate to orient the cap 25 with respect to the tool (FIG. 3). If the cap 25 becomes slightly misaligned in the socket 39 of the tool 21, one or more of the stops 47 can engage the top surface 51 of the cap to limit movement of the tool over the cap. As described above and shown in FIG. 4, the fingers 37 must move slightly outward to increase the size of the socket 39 defined by the fingers. As the fingers 37 and stops 47 cooperate to orient and align the cap 25 with respect to the tool 21, the finger movement outward induces frictional engagement of the fingers with the cap.

In the preferred embodiment, the tool 21 includes six fingers 37 and three stops 47. The stops preferably extend from every other finger 37, thereby providing equidistant spacing between the stops for balanced support of the cap 25, irrespective of which side of the cap becomes misaligned in the tool. More generally, the tool 21 may include any number of fingers 37 and stops 47, but preferably includes an even number of fingers, and half as many stops, the stops extending from every other finger.

The tool 21, including the hub 33, fingers 37 and stops 47, is preferably formed from a single piece of material. For example, the tool 21 may be formed from a flat portion of metal, such as aluminum, having a thickness of 0.25 centimeter (0.10 inch) and bent into the required tool shape. Aluminum is particularly ideal, because it allows for reshaping of the tool 21 in the field, for example if the fingers 37 of the tool should become misaligned and no longer provide a proper frictional fit. The tool 21 may also be formed from other suitable materials, such as plastic or fiberglass.

The cap 25 is preferably tamper-resistant to discourage unauthorized individuals from gaining access to the bait 31 in the pest control device 29. The cap 25 includes tabs 111 extending laterally from the edge of the cap for retaining the cap on the pest control device 29. Specifically, the cap 25 rotates into engagement with the pest control device 29, such that cavities 115 of the bait holder 30 are adapted to receive tabs 111 (FIGS. 2, 4 and 5). The tabs 111 and cavities 115 cooperate to hold the cap 25 securely on the pest control device 29. Preferably, the tabs 111 are substantially enclosed by the cavities 115 when the cap 25 is secured to the bait holder 30, thereby limiting the use of the tabs for leverage by an unauthorized individual attempting to remove the cap.

To further enhance this securement, the tabs 111 include raised nibs 113 adapted to fit within channels 117 located inside the cavities 115. The nibs 113 and channels 117 face one another, such that as the tabs 111 are rotated into the cavities 115, the tabs must flex downward to allow the nibs to pass under the top of the cavities and into the channels. Once the cap 25 rotates so that the nibs 113 and channels 117 are aligned, the downward flex of the tabs 111 is somewhat relieved as the nibs move upward into the channels. A slight tension between the nibs 113 and the channels 117 still exists, however, such that the cooperation of the nibs and channels creates an interference fit between the cap 25 and bait holder 30. The interference fit between the nibs 113 and channels 117 may be formed, for example, by configuring the nominal, or unflexed, position of the nibs to be slightly above the uppermost wall of the channels. This interference fit increases the force required to rotate and remove the cap 25, making it relatively difficult to remove an installed cap manually or without the tool 21 of the present invention. For example, such an interference may on the order of about 0.013 centimeter (0.005 inch). Because the cap 25 is relatively smooth and the tabs 111 are substantially enclosed by the cavities 115, the cap is substantially tamper-resistant. By altering the depth of the channels 117 or the height of the nibs 113, the interference can be eliminated, such that the nibs and channels engage one another, yet do not exert a force on one another. Such a configuration reduces the force required to install and remove the cap 25. To further reduce the force required to install and remove the cap 25, the nibs 113 and channels 117 may be configured with a small gap between them.

Other changes in the shape of the cap 25 and bait holder 30 can alter the force required to install or remove the cap. For example, the profile of the lateral edges of the channels 117 may be changed, such that the channel edges are inclined at an angle from vertical, thereby allowing the nibs 113 to more freely exit the channels 117. Because the nibs 113 need not pass a vertical channel edge, the force required to unseat the tabs 111 is substantially lower. Similarly, the nib 113 profile may be similarly changed to lower the resistance as the nibs slide out of the channels 117. In sum, altering the size or shape of the nibs 113 and/or channels 117 allows the interference fit between the cap 25 and bait holder 30 to be fine tuned to create specific installation and removal force characteristics, depending upon the application of the pest control device 29.

In one configuration, the tool 21 further comprises a handle 61 attached to at least one of the fingers 37 for manipulating the tool (FIGS. 2-4). The handle 61 may be shaped in a variety of ways, but preferably is generally U-shaped for manually grasping and manipulating the tool 21. The handle 61 preferably attaches to the fingers 37 with a pair of screws 65 passing upward through two holes 69 in the tool 21. The handle 61 itself comprises a U-shaped upper portion 73 and two spacers 77 between the upper portion and the holes 69. The screws 65 pass freely through the spacers 77, which are unthreaded, and thread into the handle 61 to secure it to the tool 21. The length of the spacers 77 and screws 65 may be varied to create a handle 61 spaced a greater or lesser distance from the hub 33 of the tool 21. Larger spacers 77 may be used, for example, with an individual having larger hands. Where a pest control device 29 is located at ground level G, a user of the tool 21 simply stoops, bends over, or otherwise reaches downward to engage the tool with the cap 25 of the device.

Figure 6:
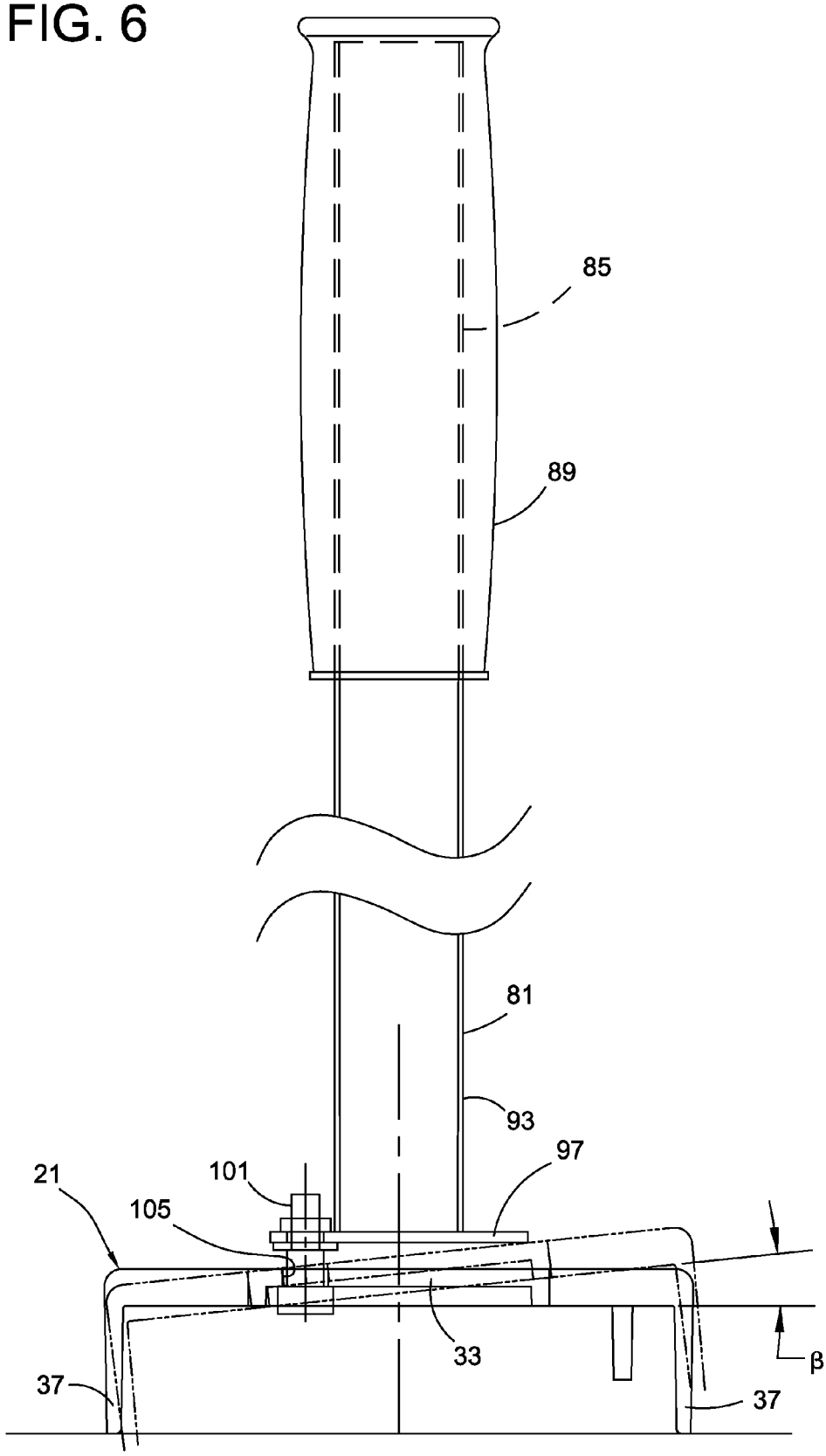
FIG. 6 is an elevation of the tool of FIG. 1 with an extension installed.

Referring now to FIG. 6, another configuration of the tool 21 comprises an extension 81 extending from the hub 33. The extension 81 facilitates manipulation of the fingers 37 and hub 33 from a location remote of the fingers and hub. The extension 81 is particularly useful in installing and removing caps 25 without stooping or bending over to reach the pest control device 29. Instead, the authorized personnel can remove the cap 25 and inspect the device 29 from a standing position. This decreases the amount of stooping or bending over required by the personnel, making inspection of multiple pest control devices 29 more efficient. An upper end 85 of the extension 81 includes a grip 89 to facilitate holding the extension and manipulating the extension and tool 21.

A bottom end 93 of the extension includes a flange 97 that attaches to the hub 33 with at least one bolt 101, and preferably three bolts. The bolts 101 are fixedly received by the flange 97, while the bolts are only loosely received by the tool 21, which includes holes 105 larger than the bolts themselves (FIGS. 1 and 6). For example, the holes 105 may have a diameter of about 0.79 centimeter (0.31 inch) while the bolts are about 0.64 centimeter (0.25 inch) in diameter. The interaction between the bolts 101 and the oversized holes 105 allows the extension 81 to pivot with respect to the hub 33 and fingers 37 of the tool 21 as shown in FIG. 6. This pivoting motion facilitates seating the tool 21 on the cap 25, because if the user does not precisely position the extension 81 perpendicular to the cap, the socket 39 of the tool can pivot on the extension to the correct orientation for receiving the cap. In other words, the extension 81 can pivot slightly with respect to the hub 33 of the tool 21 such that the fingers 37 may engage the cap 25 with the extension in a plurality of orientations. The extension 81 and hub 33 of the tool 21 are ideally perpendicular to one another during use, but the hub and fingers 37 may pivot with respect to the extension an angle β, as depicted in FIG. 6. Preferably, β is between about five degrees and about ten degrees, and more particularly about seven degrees.

The extension 81 preferably has a length of about 87.2 centimeters (34.3 inches) and is formed from metal tubing, such as steel. Such tubing, for example, may have a thickness of about 0.089 centimeter (0.035 inch). Other materials, lengths and thicknesses may be used without departing from the scope of the present invention.

In operation, the present invention contemplates a method for removing the cap 25 from the pest control device 29. The method comprises a step of engaging the fingers 37 of the tool 21 with the side edge 41 of the cap 25 of the pest control device 29. This step occurs substantially as set forth above with a tool 21 having either an extension 81 or a handle 61. After engagement, the tool 21 is rotated such that the cap 25 rotates conjointly and disengages from the pest control device 29. In particular, the rotating step may further comprise disengaging a pair of tabs 111 of the cap 25 from cavities 115 of the bait holder 30 of the pest control device 29 (FIGS. 2 and 4). The pest control device may require counter-clockwise or clockwise rotation of the tool 21 for disengagement of the cap 25 without departing from the scope of the present invention. Finally, the method comprises lifting the tool 21 from the pest control device 29 to lift the disengaged cap 25 from the pest control device.

The invention also includes a method for installing the cap 25 on the pest control device 29. The method comprises a step of engaging the fingers 37 of the tool 21 with the side edge 41 of the cap 25 of the pest control device, as described above. The method further comprises engaging the cap 25 against the pest control device 29 with the tool 21 and rotating the tool such that the cap is retained by the pest control device. More particularly, the rotating step further comprises inserting tabs 111 of the cap 25 within cavities 115 of the bait holder 30 of the pest control device 29. The tabs 111 include a chamfer 121 along a leading edge of the tab. As the cap 25 rotates into position, the chamfer 121 helps guide the tab 111 into position within the cavity 115. The method additionally comprises lifting the tool 21 from the pest control device 29 to disengage the tool from the cap 25, thereby leaving the pest control device properly capped.

Figure 7:
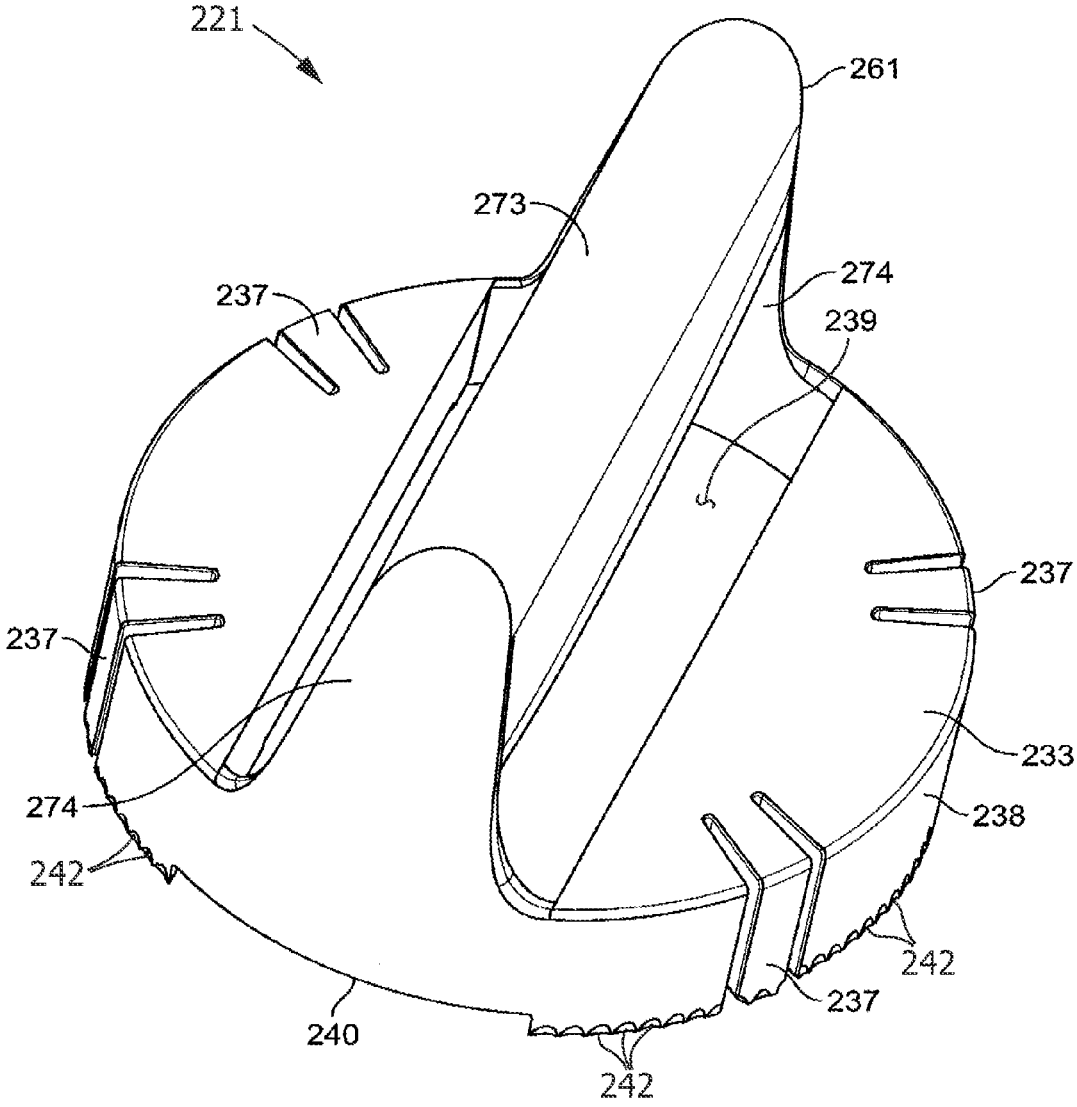
FIG. 7 is a top side perspective of another embodiment of a pest control device cap removal and installation tool.
Figure 8:
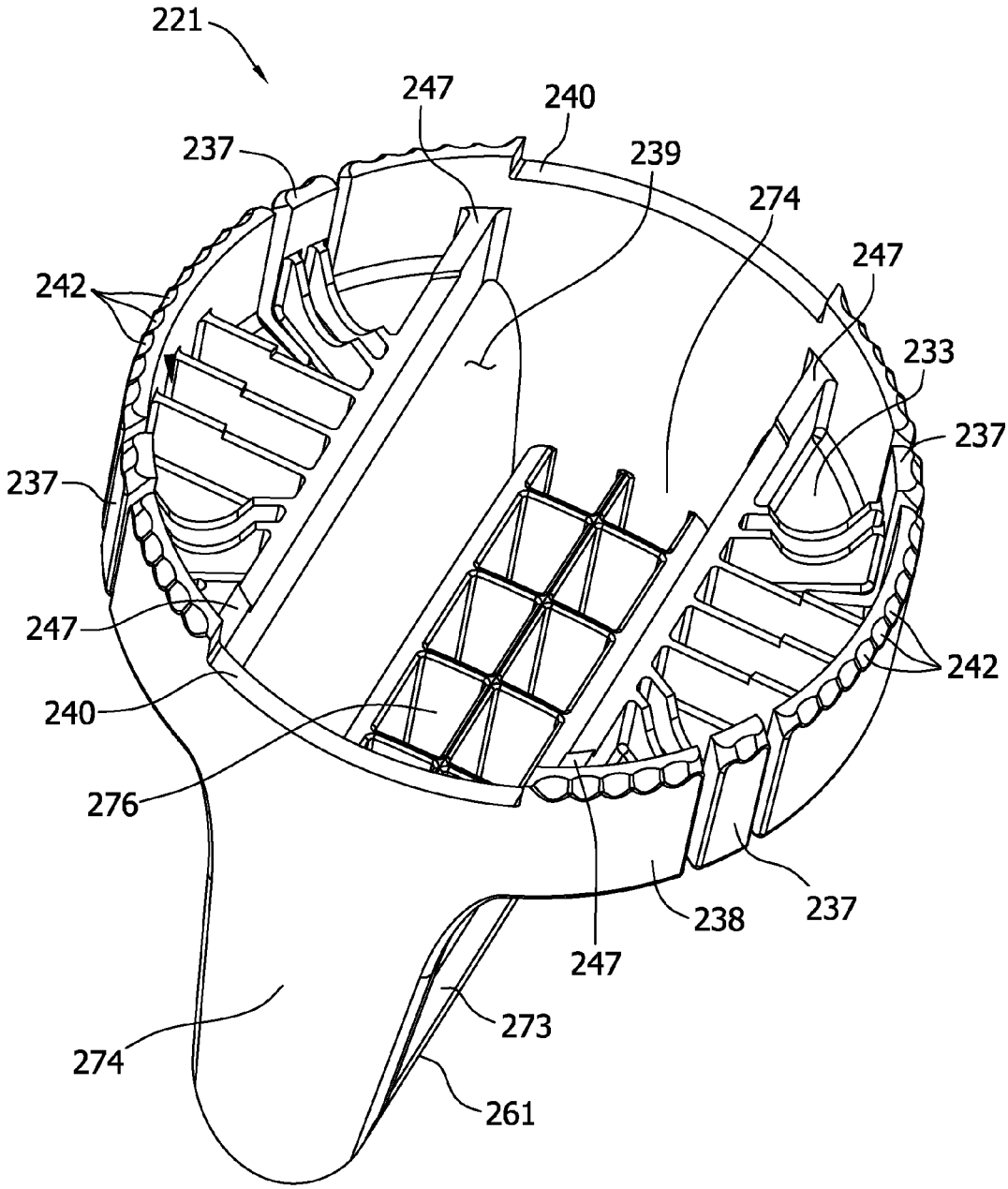
FIG. 8 is a bottom side perspective of the tool of FIG. 7.
Figure 9:
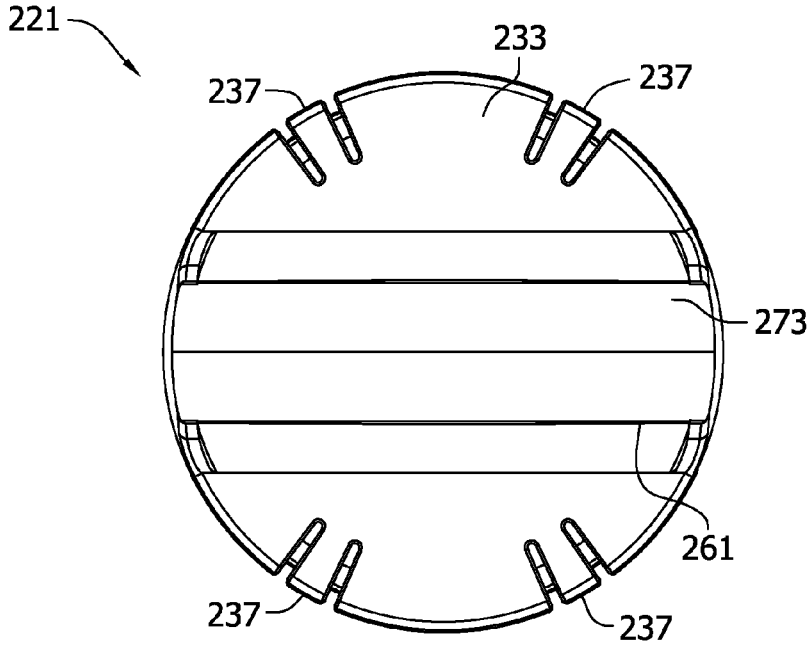
FIG. 9 is a top view of the tool.
Figure 12:
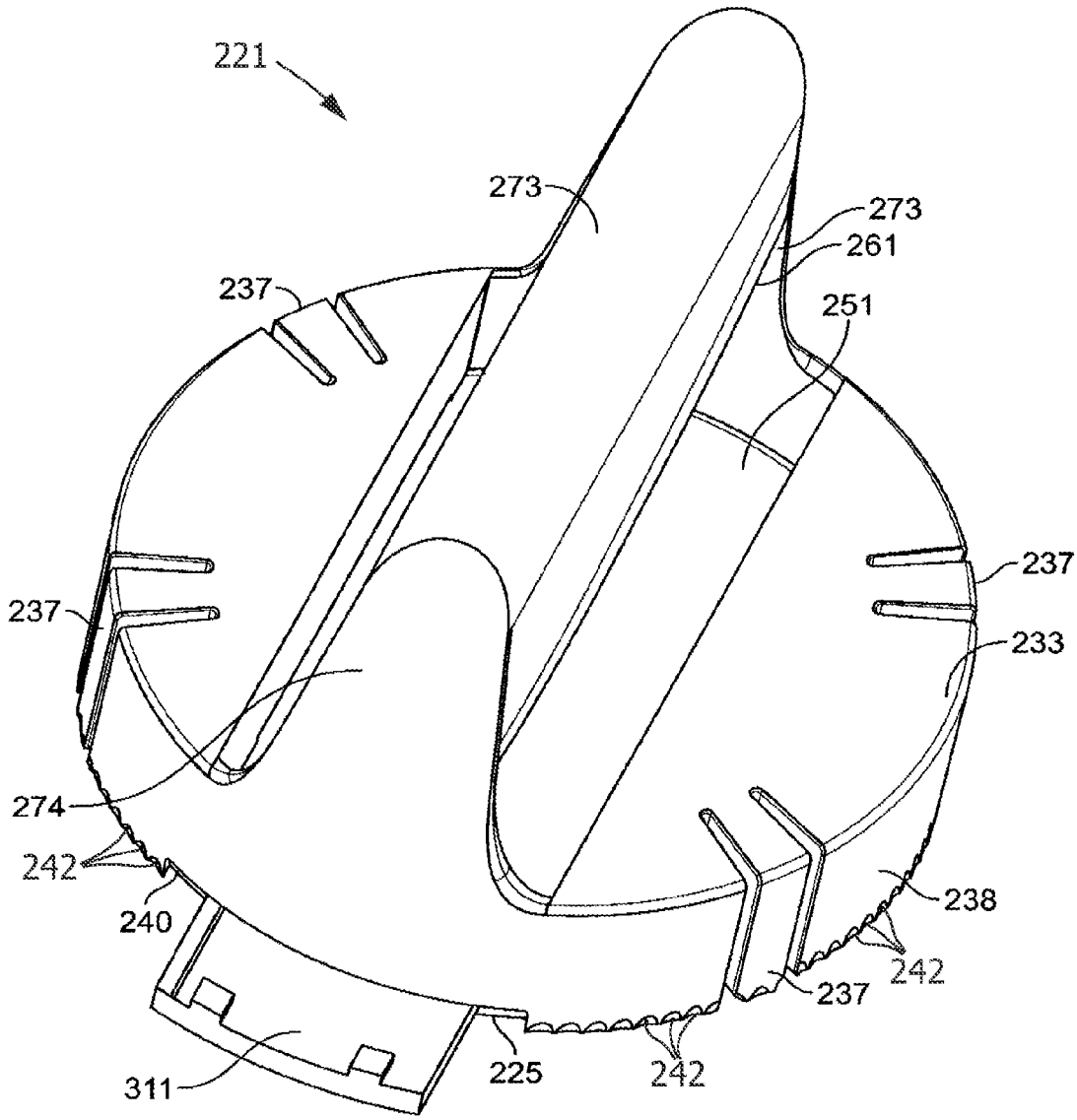
FIG. 12 is a top side perspective of the tool shown engaging a pest control device cap.
Figure 13:
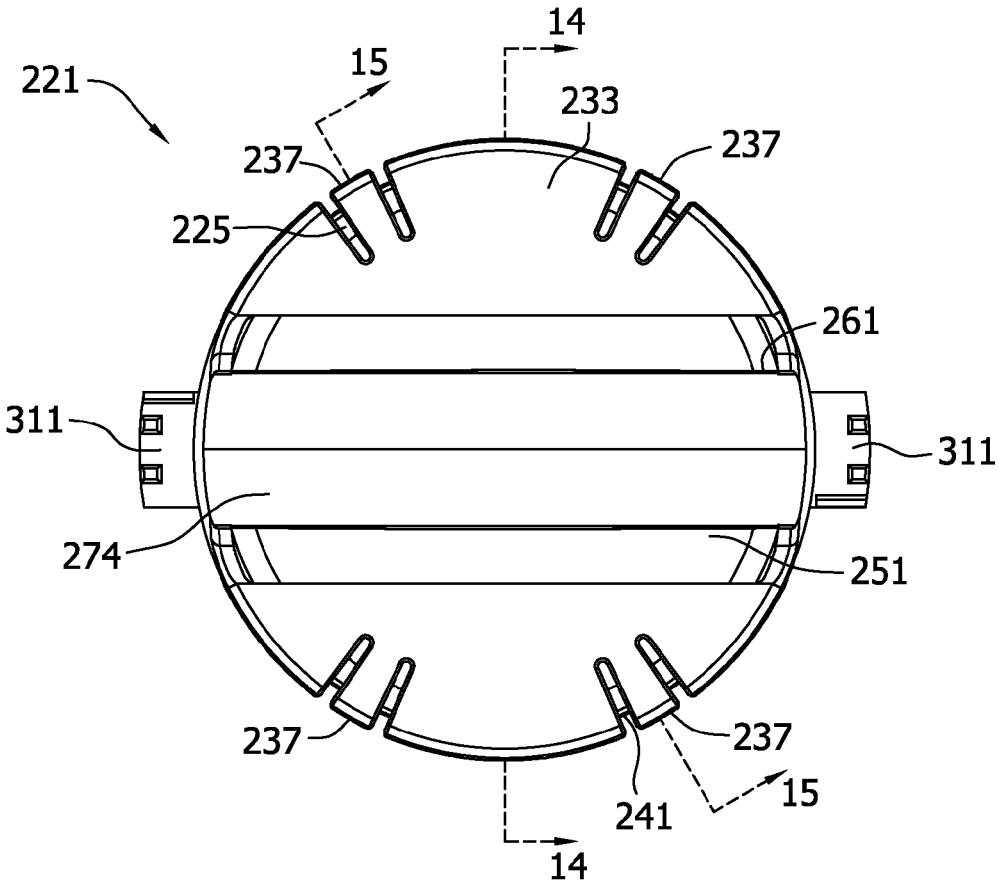
FIG. 13 is a top view thereof.
Figure 14:
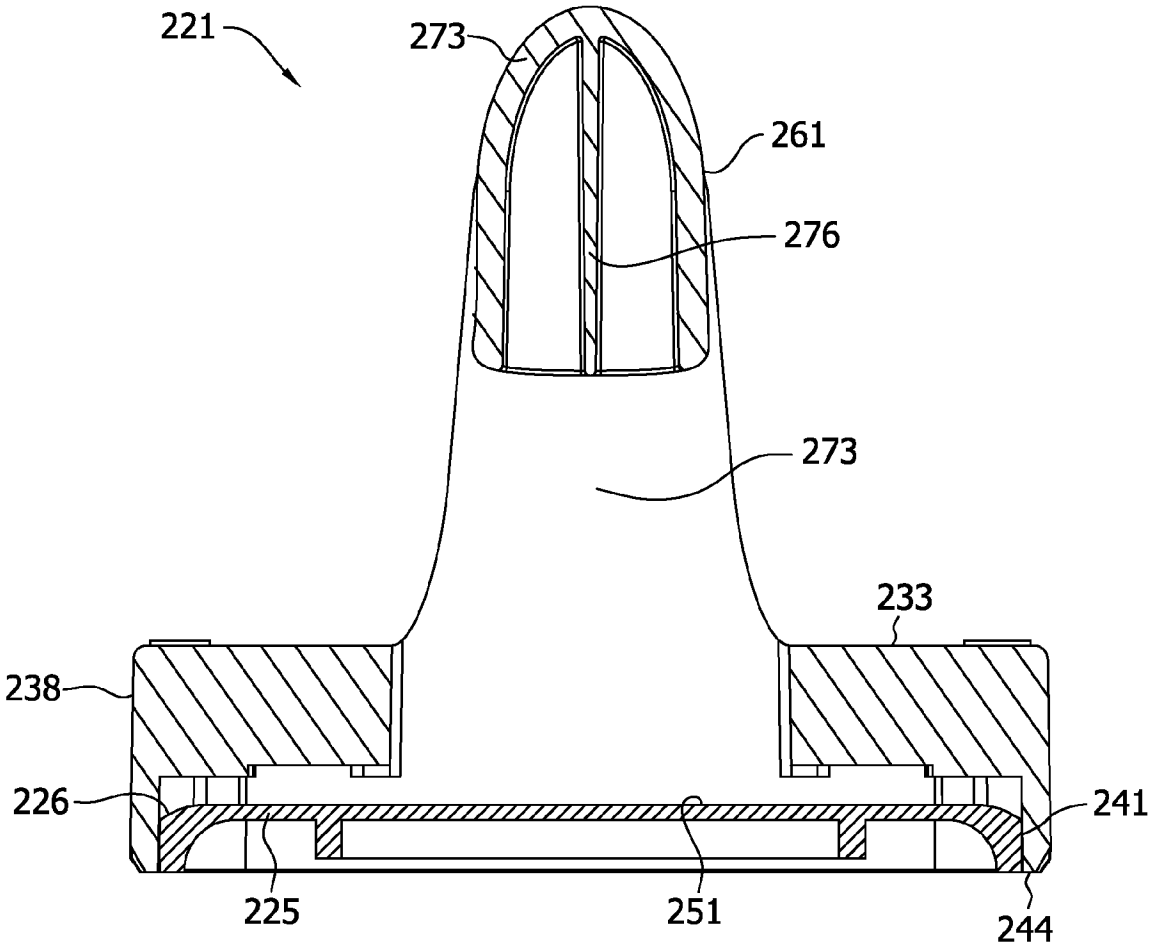
FIG. 14 is a section of the tool and cap taken in a plane including line 14-14 of FIG. 13.
Figure 15:
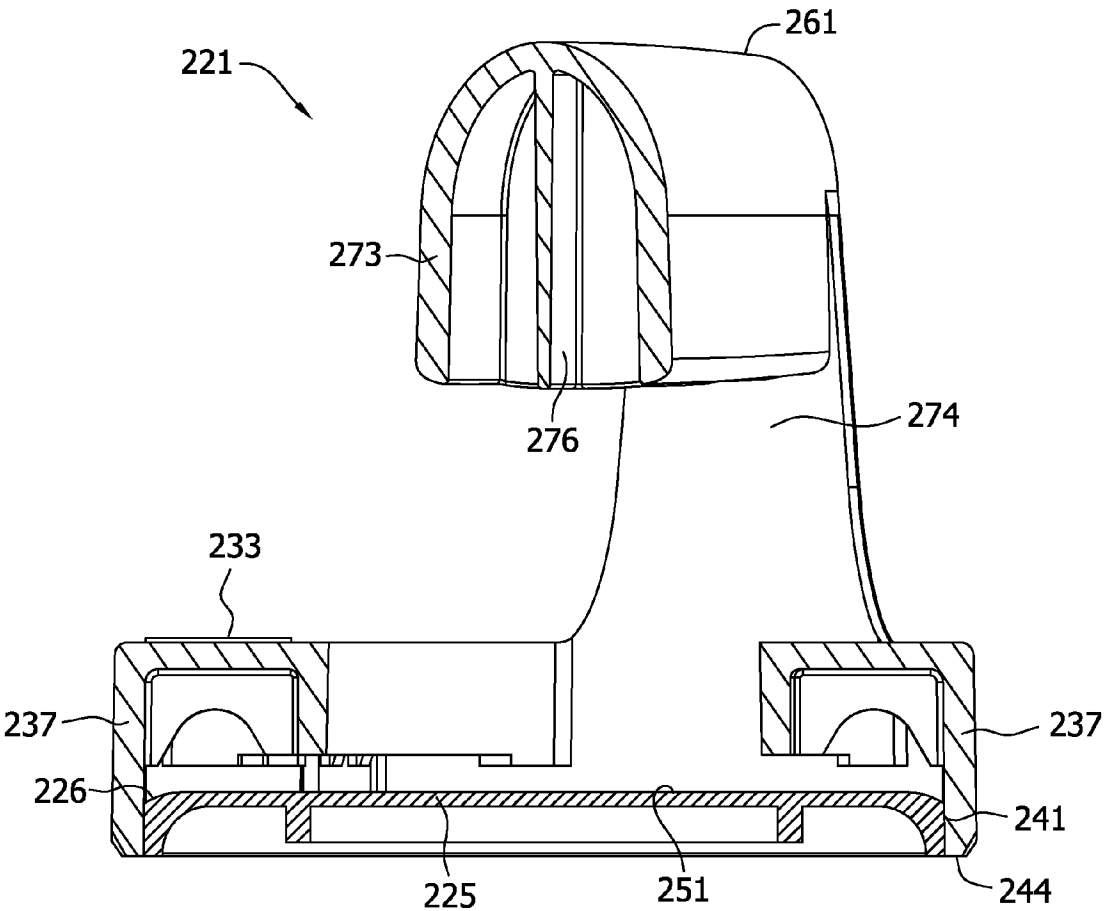
FIG. 15 is a section of the tool and cap taken in a plane including line 15-15 of FIG. 13.

FIGS. 7-15 illustrate a second embodiment of a pest control device cap removal and installation tool, indicated generally at 221, for removing a cap 225 from a pest control device (only the cap being illustrated in FIGS. 14 and 15). The tool 221 comprises a hub 233 with four fingers 237 extending radially outwardly from the hub in circumferentially spaced relationship with each other. The fingers 237 bend downward away from the hub 233 to an orientation generally parallel to one another and substantially perpendicular to the hub 233. A discontinuous or sectioned skirt 238 also extends downward away from the hub 233 and occupies the space between the fingers 237. The illustrated skirt 238 includes four separate sections that are positioned intermediate and spaced from the respective fingers 237. That is, a gap is located between each of the skirt sections and the circumferentially adjacent fingers 237. The fingers 237 and skirt 238 cooperate to define a socket 239 for receiving the cap 225. The skirt 238 includes a pair of spaced-apart cutouts 240 (FIGS. 8 and 12) configured for receiving tabs 311 extending axially from the cap 225 (FIGS. 8 and 12). More specifically, the cutouts 240 are formed in respective opposed skirt sections so that the cutouts are transversely opposite each other. The outer surfaces of the fingers 237 and skirt 238 have notches 242 (broadly, "working members") formed therein adjacent their respective distal ends to cooperatively define a patterned edge 244 of the tool 221. It is understood that the number of fingers and/or skirt sections can be less than or greater than four within the scope of this invention.

Figure 10:
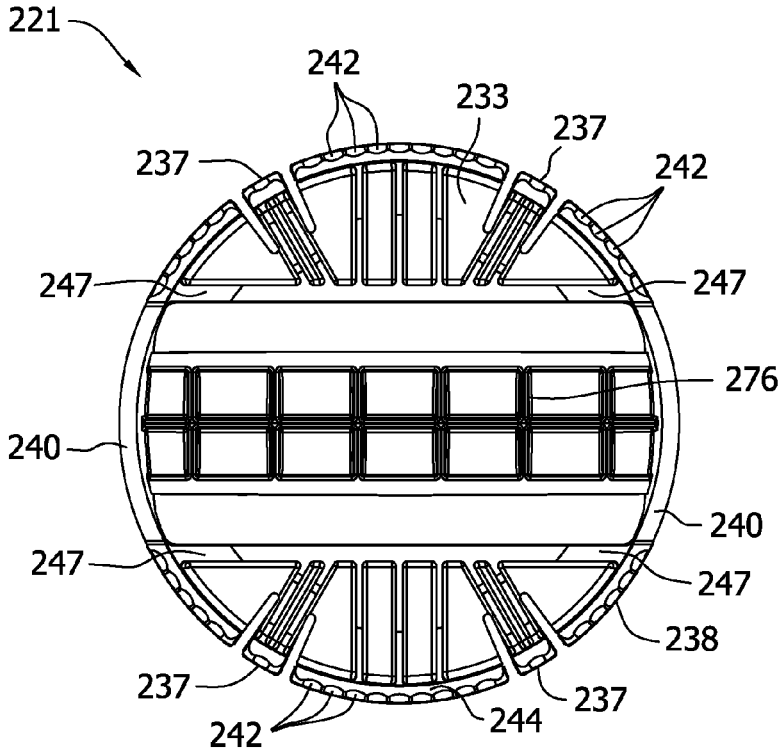
FIG. 10 is a bottom view of the tool.
Figure 11:
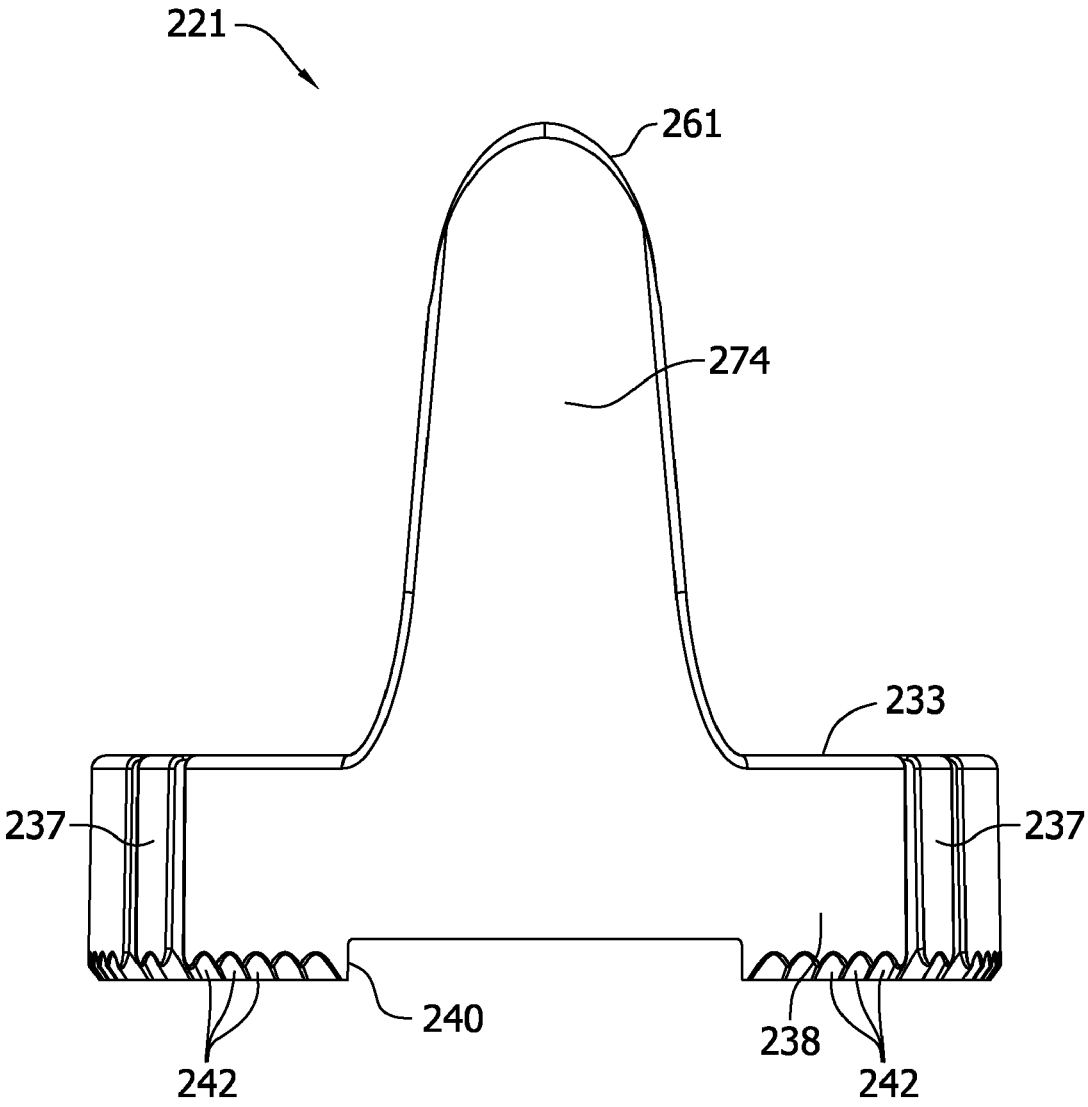
FIG. 11 is an elevation of the tool.

As illustrated in FIG. 10, the fingers 237 suitably have a thickness that is greater than the thickness of the skirt 238. As a result, the transverse (e.g., radial in the illustrated embodiment) distance between opposing fingers 237 is less than the distance between opposing skirt sections of the skirt 238. In other words, the illustrated circular tool 221 has a first radius that is defined as the distance from the center of the tool to the inner surfaces of the fingers 237, and a second radius that is defined as the distance from the center of the tool to the inner surfaces of the skirt sections, with the second radius being greater than the first radius. It is understood, however, that the fingers may have the same thickness or a thickness that is less than the skirt without departing from the scope of this invention. In this configuration, the fingers can be set inward (i.e., closer to the center of the tool) from the skirt. It is also contemplated that the fingers and skirt section inner surfaces may be equidistant (i.e., the first radius is equal to the second radius).

As illustrated in FIGS. 13-15, both the fingers 237 and skirt 238 of the tool 221 frictionally engage a sidewall 241 of the cap 225 when the cap is received by the tool. The distal ends of the fingers 237 are disposed in an unsprung position in which the transverse (e.g., radial) locations of the fingers are slightly inward of the sidewall of the cap when the tool is initially placed onto the cap. In other words, in the illustrated embodiment the distance between opposing fingers 237 is less than the diameter of the cap 225. In operation, the fingers 237 engage the sidewall 241, the fingers are urged by the cap to deflect transversely outward, to a sprung position, to receive the sidewall of the cap 225. Moving the fingers 237 to a sprung position enhances the frictional engagement of the tool 221 and cap 225, due to the increased force of the fingers pressing against the sidewall 241. Because the inner surfaces of the skirt sections are disposed transversely further from the center of the tool (and hence the cap) than the inner surfaces of the fingers 237, the fingers 237 capture the cap 225 with a greater frictional force than the skirt 238. The fingers engage the sidewall of the cap with a first force when the cap is received by the tool, while the skirt sections of the skirt 238 engage the sidewall of the cap with a second force that is less than the first force when the tool is placed on the cap. It is also contemplated that a slight gap or clearance can be provided between the skirt 238 of the tool 221 and the sidewall 241 of the cap 225. In such a configuration, the tool 221 can capture the cap 225 using only the fingers 237.

With reference to FIGS. 8 and 10, the tool 221 further includes stops 247 extending laterally inwardly into the socket 239 from the skirt 238 for engaging a top surface 251 of the cap 225. The fingers 237 and stops 247 cooperate to orient the cap 225 with respect to the tool 221 (FIG. 12-15) (i.e., within the socket 239). As described above and shown in FIG. 14, the fingers 237 move slightly outward (i.e., to the sprung position) to increase the size of the socket 239 defined by the fingers. As the fingers 237 and stops 247 cooperate to orient and align the cap 225 with respect to the tool 221, the finger movement outward induces frictional engagement of the fingers with the cap. The illustrated embodiment of the tool 221 includes four stops 247 but it is understood that the tool can have more or fewer stops. The four stops 247 result in four contact points between the tool 221 and the top surface 251 of the cap 225 but the number of contact points can be increased or decreased by adding or subtracting, respectively, the number of stops provided on the tool. In the illustrated embodiment, the tool 221 includes the same number of fingers 237 as stops 247 (i.e., four). It is understood, however, that the number of fingers 237 and stops 247 can be different. That is, the tool can have more fingers than stops or more stops than figures without departing from the scope of this invention.

As illustrated in FIG. 7, the tool 221 further comprises a handle 261 attached to the hub 233 for manipulating the tool. The handle 261 may be shaped in a variety of ways, but is generally U-shaped in the illustrated embodiment for facilitating manually grasping and manipulating the tool 221. The handle 261 comprises an upper portion 273 and two connecting portions 274 extending downward from opposite longitudinal ends of the upper portion 273 and connecting the upper portion to the hub 233. The upper portion 273 includes an interior space that is reinforced by a plurality of reinforcing members 276 (FIGS. 8). It is understood that the tool 221 could include a handle having a different configuration than illustrated herein without departing from the scope of this invention. In this embodiment, the tool 221 is formed as one-piece from a suitable material, such as molded from plastic. But it is understood that the tool can be formed from multiple pieces and from other suitable materials besides plastic.

In operation, the tool 221 can be used to remove the cap 225 from the pest control device 229. With the cap 225 secured to the pest control device 229 (e.g., as illustrated in FIG. 4), the tool 221 is aligned with the cap 225 and pushed downward so that the majority of the cap is received in the socket 239 and the tabs 311 of the cap are received by respective notches 240 in the skirt sections (FIGS. 12 and 13). As the tool 221 is pushed downward on the cap 225, a tapered annular edge 226 of the cap facilitates sliding motion of the lower edge 244 of the tool over the edge of the cap. As the tool 221 is urged down over the cap 225, the fingers 237 slide along the tapered edge of the cap and are urged from their unsprung position to their sprung position wherein the fingers frictionally grip the cap and thereby capture the cap. The tool 221 is suitably (but not necessarily) pushed downward over the cap until the stops 247 engage the top surface of the cap 225. In this condition, the skirt sections are in a relatively light frictional contact with the cap sidewall while the fingers are in greater frictional contact therewith.

After engagement, the tool 221 is rotated relative to the cap until the skirt sections contact the tabs extending from the cap. Upon further rotation of the tool, the cap 225 rotates conjointly therewith and disengages from the pest control device 229. The notches 242 formed in the fingers 237 and skirt 238 suitably cut through and push away from the tool 221 sand, dirt and/or other debris that may have accumulated on the pest control device 229. In short, the notches 242 act generally in the manner of a knife to cut through any debris that has accumulated on the bait station as the tool is urged downward into engagement with the cap and in the manner of a plow as the tool 221 is rotated either clockwise or counterclockwise to push any debris away from the tool. Each of the illustrated notches 242 has an edge that tapers inward which enables the tool to cut and plow debris. It is understood, however, that the notches can have different configurations (e.g., squared edges). It is also understood that the notches can be replaced with bumps or other suitable structures that extend outward from the fingers and/or skirt and provide similar cutting and plowing ability.

As explained above, the rotating step disengages the tabs 111 of the cap 225 from cavities of the pest control device 229. The pest control device 229 may require counter-clockwise or clockwise rotation of the tool 221 for disengagement of the cap 225 without departing from the scope of the present invention. Finally, the tool 221 is lifted from the pest control device 229 to thereby lift the disengaged cap 225 from the pest control device.

The tool 225 can also be used to install the cap 225 on the pest control device 229. With the fingers 237 and skirt 238 of the tool 221 engaged with the sidewall 241 of the cap 225 of the pest control device, as described above, the tool is used to place the cap against the pest control device 229 and rotated so that the cap is retained by the pest control device. More particularly, rotation of the cap 225 results in the tabs 311 of the cap to be inserted within cavities of the pest control device 229. The tool 221 is lifted from the pest control device 229 to disengage the tool from the cap 225, thereby leaving the pest control device properly capped.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A tool for removing a cap from a pest control device, said cap having a top and a sidewall depending from said top, the tool comprising:

a hub, at least two fingers depending from the hub at an angle relative thereto, the fingers being in opposed relationship with each other, the opposed fingers each having a lower edge, said opposed fingers having a first transverse distance between the lower edges thereof so that inner surfaces of the fingers engage the sidewall of the cap when the cap is received by the tool, the lower edges of the fingers engaging the pest control device when the cap is disposed on the pest control device and the cap is received by the tool; and at least two skirt sections configured different from said fingers, said skirt sections depending from the hub and disposed adjacent said fingers and in opposed relationship with each other, the opposed skirt sections each having a lower edge, said opposed skirt sections having a second transverse distance between the lower edges thereof that is greater than the first transverse distance between the lower edges of the opposed fingers, said fingers being resiliently moveable relative to said skirt sections, each of the fingers being circumferentially spaced from the adjacent skirt section by a gap, at least a portion of the gap being formed in the hub, the at least two fingers and the at least two skirt sections being circularly aligned such that each of the fingers and each of the skirt sections lie on a common circle.

2. A tool as set forth in claim 1 wherein the fingers each have a greater thickness than a thickness of each of said skirt sections.

3. A tool as set forth in claim 1 wherein the tool comprises four fingers, the fingers being arranged about the hub in opposed pairs.

4. A tool as set forth in claim 1 wherein the skirt sections are adapted to engage the sidewall of the cap when the cap is received by the tool.

5. A tool as set forth in claim 4 wherein the fingers are adapted to engage the sidewall of the cap with a first force when the cap is received by the tool, and the skirt sections are adapted to engage the sidewall of the cap with a second force when the cap is received by the tool, the first force being greater than the second force.

6. A tool as set forth in claim 1 wherein the tool is of a single-piece construction.

7. A tool as set forth in claim 6 wherein the tool is plastic.

8. A tool as set forth in claim 1 wherein each of the skirt sections comprises a cutout for receiving a portion of the cap when the cap is received by the tool, the cutouts being circumferentially spaced apart from the fingers.

9. A tool as set forth in claim 1 wherein the skirt sections and fingers collectively define a lower edge of the tool, at least a portion of a surface of the skirt sections and fingers adjacent the lower edge of the tool being notched such that a lower edge of the notched portion lies in a different plane than the lower edge of the tool.

10. A tool as set forth in claim 1 in combination with a cap of a pest control device.

11. A tool as set forth in claim 1 wherein the lower edges of the fingers and the lower edges of the skirts sections are co-terminal.

12. A tool for removing a cap from a pest control device, said cap having a top and a sidewall depending from said top, the tool comprising a hub, at least two fingers depending from the hub at an angle relative thereto, and a skirt extending downward from the hub, said fingers being in circumferentially spaced relationship with each other and the skirt to cooperatively define a socket for receiving the cap within the tool, each of the fingers having a lower edge and an outer surface, the outer surface of each finger having at least one working member formed therein adjacent the lower edge of said finger, said at least one working member tapering transversely inward from the outer surface to the lower edge of each finger, each of the fingers being resiliently moveable relative to the hub, the skirt comprising a cutout for receiving a portion of the cap when the cap is received by the tool, the fingers and the skirt being circularly aligned such that each of the fingers and the skirt lie on a common circle.

13. A tool as set forth in claim 12 wherein the skirt has a lower edge and an outer surface, the outer surface of the skirt having at least one working member formed therein adjacent the lower edge of the skirt.

14. A tool as set forth in claim 13 wherein the at least one working member formed in the outer surface of the skirt comprises at least one notch.

15. A tool as set forth in claim 14 wherein the fingers are moveable between an unsprung position and a sprung position wherein the fingers are adapted to capture the cap.

16. A tool as set forth in claim 12 wherein the fingers are configured to engage the sidewall of the cap when the cap is received by the tool.

17. A tool as set forth in claim 15 wherein the skirt is configured to engage the sidewall of the cap when the cap is received by the tool.

18. A tool as set forth in claim 12 wherein the lower edges of the fingers and the lower edges of the skirt are generally co-terminal.

19. A tool for removing a cap from a pest control device, said cap having a top and a sidewall depending from said top, the tool comprising:

a hub, at least two fingers depending from the hub at an angle relative thereto, the fingers being in opposed relationship with each other, the opposed fingers each having a lower edge, said opposed fingers having a first transverse distance between the lower edges thereof so that inner surfaces of the fingers engage the sidewall of the cap when the cap is received by the tool, the lower edges of the fingers engaging the pest control device when the cap is disposed on the pest control device and the cap is received by the tool; and at least two skirt sections configured different from said fingers, said skirt sections depending from the hub and disposed circumferentially adjacent said fingers and in opposed relationship with each other, the opposed skirt sections each having a lower edge, said opposed skirt sections having a second transverse distance between the lower edges thereof that is greater than the first transverse distance between the lower edges of the opposed fingers, said fingers being resiliently moveable relative to said skirt sections, wherein the skirt sections are adapted to engage the sidewall of the cap when the cap is received by the tool, and wherein the fingers are adapted to engage the sidewall of the cap with a first force when the cap is received by the tool, and the skirt sections are adapted to engage the sidewall of the cap with a second force when the cap is received by the tool, the first force being greater than the second force, the at least two fingers and the at least two skirt sections being circularly aligned such that each of the fingers and each of the skirt sections lie on a common circle.

20. A tool as set forth in claim 19 in combination with a cap of a pest control device.

* * * * *

UNITED STATES PATENT AND TRADEMARK OFFICE

CERTIFICATE OF CORRECTION

PATENT NO. : 8,225,697 B2
APPLICATION NO. : 13/178214
DATED : July 24, 2012
INVENTOR(S) : Cink et al.

It is certified that error appears in the above-identified patent and that said Letters Patent is hereby corrected as shown below:

Claim 17, Column 10, Line 65, delete "in claim 15" and insert therefor -- in claim 16 --.

Signed and Sealed this
Twelfth Day of March, 2013

Teresa Stanek Rea
*Acting Director of the United States Patent and Trademark Office*